US008978433B2

(12) United States Patent
Kamitani et al.

(10) Patent No.: US 8,978,433 B2
(45) Date of Patent: Mar. 17, 2015

(54) PIPE DIAMETER EXPANSION APPARATUS AND PIPE DIAMETER EXPANSION METHOD

(71) Applicant: Mitsubishi Heavy Industries, Ltd., Tokyo (JP)

(72) Inventors: Keisuke Kamitani, Tokyo (JP); Kazuhiko Kamo, Tokyo (JP); Jiro Kasahara, Tokyo (JP); Yukihiro Sakaguchi, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/952,787

(22) Filed: Jul. 29, 2013

(65) Prior Publication Data

US 2014/0090434 A1 Apr. 3, 2014

(30) Foreign Application Priority Data

Sep. 28, 2012 (JP) ..... 2012-216707

(51) Int. Cl.

| | |
|---|---|
| ***B21D 9/15*** | (2006.01) |
| ***B21D 26/02*** | (2011.01) |
| ***B21D 26/033*** | (2011.01) |
| ***B21D 39/08*** | (2006.01) |

(52) U.S. Cl.

CPC ..... *B21D 26/033* (2013.01); *B21D 39/08* (2013.01)

USPC ..... 72/62; 72/58; 72/370.22

(58) Field of Classification Search

USPC ..... 72/54, 57, 58, 62, 370.22

See application file for complete search history.

(56) References Cited

U.S. PATENT DOCUMENTS

| | | | | |
|---|---|---|---|---|
| 3,977,068 | A * | 8/1976 | Krips | 72/62 |
| 4,198,740 | A * | 4/1980 | Prevender | 72/54 |
| 5,813,266 | A * | 9/1998 | Ash | 72/57 |
| 5,884,516 | A * | 3/1999 | Tseng | 72/58 |
| 6,701,764 | B2 * | 3/2004 | Bruck et al. | 72/62 |

FOREIGN PATENT DOCUMENTS

| | | | |
|---|---|---|---|
| JP | 58-184391 | A | 10/1983 |
| JP | 1-29631 | B2 | 6/1989 |
| JP | 1-44437 | B2 | 9/1989 |
| JP | 2006-334596 | A | 12/2006 |
| JP | 2009-050906 | A | 3/2009 |
| JP | 2011-131252 | A | 7/2011 |

OTHER PUBLICATIONS

Nakaya, Michisuke, "Development of Stress Relief Method for Weld Joint of Pipe using Ice Plug", Quarterly Journal of the Japan Welding Society, Japan, 1994, vol. 12 No. 1, pp. 132-136, w/English abstract.

* cited by examiner

*Primary Examiner* — David B Jones

(74) *Attorney, Agent, or Firm* — Westerman, Hattori, Daniels & Adrian, LLP

(57) ABSTRACT

A pipe diameter expansion apparatus includes: a hollow cylindrical member that can be placed in a pipe filled with water, and through which a coolant medium having a lower temperature than a freezing point of the water flows from one end to the other end; at least two plate-like fins provided to protrude outward from the cylindrical member; and a cold-heat insulator that is provided between the two fins, and reduces cold-heat transmission between inside and outside the cylindrical member.

4 Claims, 4 Drawing Sheets

PIPE DIAMETER EXPANSION APPARATUS AND PIPE DIAMETER EXPANSION METHOD

TECHNICAL FIELD

The present invention relates to a pipe diameter expansion apparatus and a pipe diameter expansion method for radially expanding a pipe.

BACKGROUND ART

In piping engineering, various methods are known to radially expand a pipe. For example, there are a method of injecting water into a divided longitudinal range at an end of the pipe and expanding the diameter of the pipe using hydraulic pressure, and a method of inserting a roller from one end of the pipe and mechanically expanding the diameter of the pipe using a pressing force from the roller, which are only for expanding the end of the pipe.

Also, NPL 1 mentioned below has an object to relieve residual stress at a weld joint. Meanwhile, NPL 1 discloses a method of forming ice plugs at two longitudinal spots in a pipe with a weld joint therebetween, and plastically deforming the pipe using volume expansion and an increase in internal pressure when water trapped between the two ice plugs turns into ice as the ice plugs grow.

CITATION LIST

Non Patent Literature

NPL 1

Nayama, Akitomo, "Development of Stress Relief Method for Weld Joint of Pipe using Ice Plug", Quarterly Journal of the Japan Welding Society, Japan Welding Society, 1994, vol. 12, No. 1, pages 132-136.

SUMMARY OF INVENTION

Technical Problem

The above described method disclosed in NPL 1 cools an outer surface of the pipe to be expanded using liquid nitrogen or the like to form the ice plugs. Thus, a cooling unit to which a coolant medium such as liquid nitrogen is supplied, and a coolant medium pipe connected to the cooling unit need to be placed outside the pipe.

However, since there is not much space because a plurality of pipes are densely placed or other devices are placed around the pipe, the cooling unit or the coolant medium pipe cannot be placed outside the pipe or an operator cannot come close to the pipe in some cases.

Also, a method of expanding a diameter of a pipe from inside the pipe using hydraulic pressure or a roller is a technique for expanding only a pipe end, and a pipe diameter of a middle portion of the pipe which is apart from the pipe end cannot be expanded.

The present invention is made in view of such circumstances, and has an object to provide a pipe diameter expansion apparatus and a pipe diameter expansion method that can expand a diameter of a pipe in a position having little space outside the pipe and apart from the pipe ends.

Solution to Problem

In order to solve the above described problem, a pipe diameter expansion apparatus and a pipe diameter expansion method according to the present invention employ the following solutions.

Specifically, a pipe diameter expansion apparatus according to the present invention includes: a hollow cylindrical member which can be placed in a pipe filled with water, and through which a coolant medium having a lower solidification point than a freezing point of the water flows from one end to the other end thereof; two or more plate-like fins provided to protrude outward from the cylindrical member; and a cold-heat transmission reduction unit that is provided between the fins, and reduces cold-heat transmission between an inside and an outside of the cylindrical member.

According to this configuration, when the coolant medium is passed from one end to the other end of the cylindrical member while the cylindrical member is placed in the pipe filled with water, cold-heat transmission occurs between the inside and the outside of the cylindrical member, and water starts to freeze on an outer surface of the cylindrical member or an outer surface of the fins where no cold-heat transmission reduction member is provided. Since the fin is formed to protrude outward from the cylindrical member, an ice plug that blocks the gap between the cylindrical member and an inner wall of the pipe is easily formed. Solidification of water in the pipe proceeds toward the area between the two fins. As a result, the water remaining between the two fins is trapped. Since phase transformation from water to ice involves volume expansion, pressure of the remaining water gradually increases. Thus, the water pressure and the volume expansion when the water turns into ice plastically deform the pipe to expand a pipe diameter between the two fins.

When there are fluids on both sides of a pipe wall of the cylindrical member with a temperature difference therebetween, it causes two phenomena: convection heat transfer between the wall of the cylindrical member and the fluid; and conductive heat transfer inside the wall of the cylindrical member, and the cold-heat transmission reduction unit prevents at least one of these phenomena. The cold-heat transmission reduction unit is provided between the two fins, and thus when a coolant medium flows through the cylindrical member, solidification of water is delayed between the two fins as compared to that on the outer surface of the cylindrical member or on the outer surface of the fin where no cold-heat transmission reduction member is provided. Thus, an ice plugs are first formed at the two fins, and water can reliably remain between the two fins.

Further, the cylindrical member can be placed in any position in the pipe, without being limited to a position in the axial direction of the pipe, for example, pipe ends, and thus a pipe diameter can be expanded in a position apart from the pipe ends.

The above described invention may further include two hoses more elastic than the cylindrical member and connected to ends of the cylindrical member, respectively, and the coolant medium flows through the hoses.

According to this configuration, the hose supplies the coolant medium to the cylindrical member, and discharges the coolant medium from the cylindrical member. Since the hose is more elastic than the cylindrical member, the cylindrical member can be easily placed in a pipe having curvature. Also, even if ice is formed on the hose with the ice growing from the outer surface of the cylindrical member or the outer surface of the fin, the hose is elastically deformed to prevent a pipe diameter from being expanded outside the area between the two fins. Thus, by positioning the two fins at both sides of an area where the pipe diameter is to be expanded, only a required area can be reliably expanded.

The present invention also provides a pipe diameter expansion method using the above described pipe diameter expansion apparatus, including the steps of: filling a pipe with water; placing the pipe diameter expansion apparatus in the pipe; and supplying the coolant medium into the cylindrical member of the pipe diameter expansion apparatus.

Advantageous Effects of Invention

According to the present invention, the pipe diameter expansion apparatus provided in the pipe can cool the inside of the pipe, and the pipe diameter expansion apparatus can be placed at any position without being limited to a position in the axial direction of the pipe. Thus, a pipe diameter in a position with little space outside the pipe and apart from the pipe ends can be expanded.

DESCRIPTION OF EMBODIMENTS

Now, an embodiment of the present invention will be described with reference to the drawings.

First, a pipe diameter expansion apparatus 1 according to this embodiment will be described.

Figure 1:
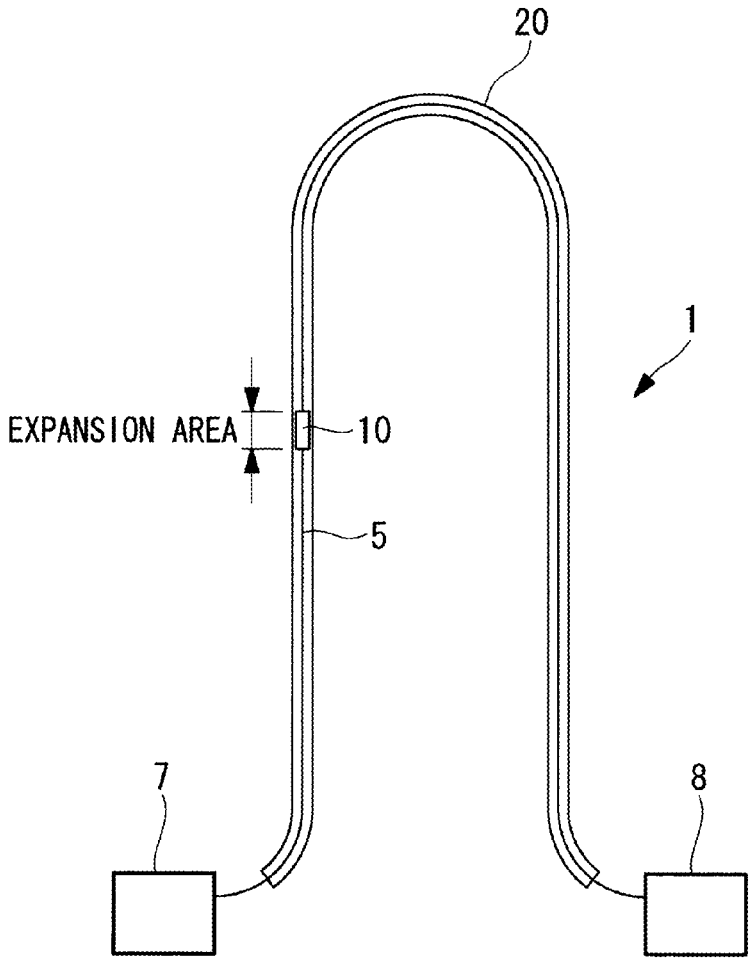
FIG. 1 is an overall schematic view of a pipe diameter expansion apparatus according to an embodiment of the present invention.

As shown in FIG. 1, in the pipe diameter expansion apparatus 1, an ice plug forming unit 10 is placed in a pipe 20. The pipe diameter expansion apparatus 1 can form an ice plug in the pipe 20 to expand a diameter of the pipe 20. The pipe 20 whose diameter is to be expanded is, for example, a pipe provided in a heat exchanger, a condenser, a steam generator in a pressurized water reactor (PWR), or the like.

Figure 2:
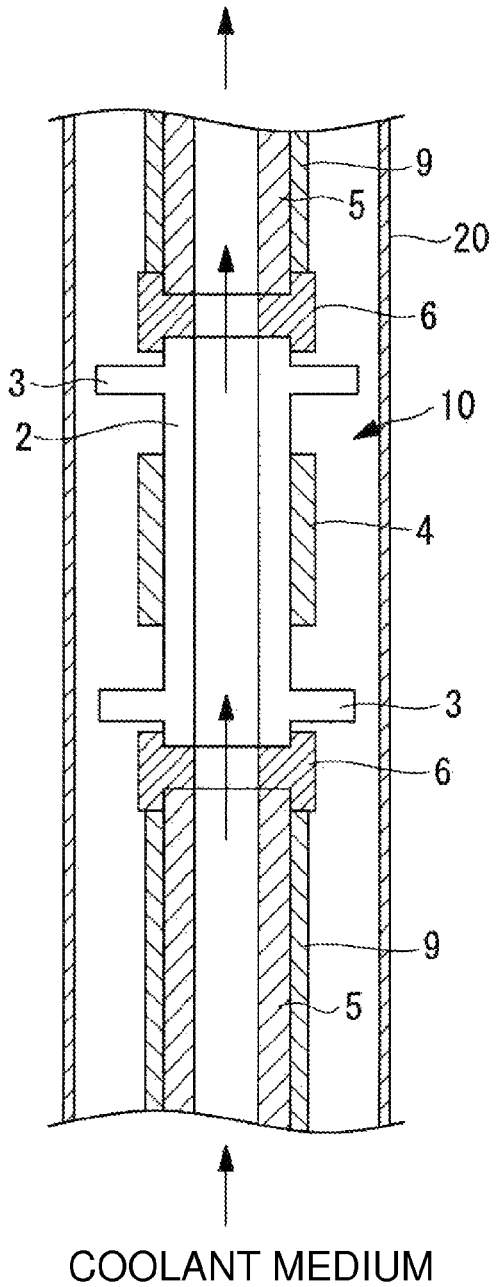
FIG. 2 is a partially enlarged vertical sectional view of the pipe diameter expansion apparatus according to the embodiment of the present invention.

As shown in FIG. 2, the ice plug forming unit 10 of the pipe diameter expansion apparatus 1 is placed in the pipe 20 filled with water, cools the water in the pipe 20, and forms ice plugs at least at two longitudinal spots in the pipe 20. Then, pressure of water remaining between the formed two ice plugs and volume expansion caused in phase transformation from water to ice can plastically deform the pipe 20 from the inside to the outside to expand the pipe diameter. As shown in FIG. 1, the pipe diameter expansion apparatus 1 includes the ice plug forming unit 10, a flexible hose 5, a coolant supply device 7, a coolant recovery device 8, and the like.

As shown in FIG. 2, the ice plug forming unit 10 includes a cylindrical member 2, a fin 3, a heat insulator 4, a joint 6, and the like.

The cylindrical member 2 is a hollow member through which a coolant medium flows from one end to the other end thereof. The coolant medium is made of a substance having a lower solidification point than a freezing point of water, for example, liquid nitrogen. The cylindrical member 2 is made of a material for easily conducting heat in a pipe wall, for example, metal such as steel or an aluminum alloy. The cylindrical member 2 has a material and a structure resistant to plastic deformation by an increase in liquid pressure or volume expansion when water is frozen and turns into ice between an inner wall of the pipe 20 in which the ice plug forming unit 10 is placed and an outer wall of the cylindrical member 2. Thus, the increase in liquid pressure or volume expansion is used to plastically deform the pipe 20 rather than the cylindrical member 2, thereby reliably expanding the pipe diameter.

The flexible hose 5 is connected via the joint 6 to each end of the cylindrical member 2. The cylindrical member 2 receives the coolant medium from the flexible hose 5 on one end side, and discharges the coolant medium to the flexible hose 5 on the other end side.

The fin 3 is provided on an outer peripheral surface of the cylindrical member 2, and has a shape that protrudes outward from the cylindrical member 2. The fin 3 is, for example, an annular plate-like member made of a material in which heat is easily conducted as well as the cylindrical member 2 (for example, metal such as steel or an aluminum alloy). An outer diameter of the fin 3 is smaller than an inner diameter of the pipe 20. The fin 3 is provided to increase a surface area that allows heat exchange between the water in the pipe 20 and the coolant medium in the ice plug forming unit 10. The fin 3 is formed to protrude outward from the cylindrical member 2, and thus an ice plug that blocks the gap between the ice plug forming unit 10 and the inner wall of the pipe 20 is easily formed.

The fin 3 desirably has strength resistant to a force parallel to the axial direction of the pipe caused by volume expansion when formation of ice proceeds in the gap between the ice plug forming unit 10 and the inner wall of the pipe 20. Thus, formation of ice proceeds in a pipe radial direction in the gap between the ice plug forming unit 10 and the inner wall of the pipe 20, thereby reliably expanding the pipe diameter.

The fin 3 is formed at or near the end of the cylindrical member 2. The fin 3 is not limited to the annular shape. In the example shown in FIG. 2, only one fin 3 is formed at each longitudinal spot of the cylindrical member 2, but a plurality of fins 3 may be formed at each longitudinal spot. A length of the cylindrical member 2 or a distance between the two fins 3 is determined according to a longitudinal area of the pipe diameter to be expanded.

The cold-heat insulator 4 is an example of a cold-heat transmission reduction unit, and provided on the outer peripheral surface of the cylindrical member 2 between the fins 3 at 2 spots. The cold-heat insulator 4 is made of a material having lower heat conductivity than the cylindrical member 2 and the fins 3. When there are water on one side and the coolant medium on the other side of the pipe wall of the cylindrical member 2 with a temperature difference therebetween, it causes two phenomena: convection heat transfer between the wall and the fluid, and conductive heat transfer inside the wall. The cold-heat insulator 4 prevents one or both of these phenomena. The cold-heat insulator 4 is provided between the two fins 3, and thus if a coolant medium flows through the cylindrical member 2, solidifying water is delayed between the two fins 3 as compared to that on the outer surface of the cylindrical member 2 or on the outer surface of the fin 3 where no cold-heat insulator 4 is provided. Thus, ice plugs are first formed at the two fins 3, and water can reliably remain between the two fins 3.

An area of the cold-heat insulator 4 covering the cylindrical member 2 is determined based on, for example, a freezing speed of water in the pipe 20, or a position where water is frozen first.

The flexible hoses 5 are connected to each end of the cylindrical member 2, and the coolant medium flows through the flexible hose 5. The flexible hose 5 is connected at one end side to a coolant medium supply side of the cylindrical member 2, and at the other end side to the coolant supply device 7.

The flexible hose 5 connected at one end side to a coolant medium discharge side of the cylindrical member 2 is connected at the other end side to the coolant recovery device 8. A cold-heat insulator 9 is applied to an outer peripheral surface of the flexible hose 5, and the cold-heat insulator 9 prevents water around the flexible hose 5 from freezing by the coolant medium.

The flexible hose 5 supplies the coolant medium to the ice plug forming unit 10, and discharges the coolant medium from the ice plug forming unit 10. The flexible hose 5 is flexible, and thus the ice plug forming unit 10 can be easily placed in the pipe 20 having curvature. The flexible hose 5 is more elastic than the cylindrical member 2. Thus, even if ice is formed on the flexible hose 5 with ice growing from the outer surface of the cylindrical member 2 and the outer surface of the fin 3, the flexible hose 5 can be elastically deformed inward, thereby preventing expansion of the pipe diameter outside the longitudinal area between the two fins 3. Thus, by positioning the two fins 3 at the both ends of the expansion area of the pipe whose diameter is to be expanded, only a required longitudinal range can be expanded.

The cylindrical member 2 and the flexible hose 5 are connected by the joint 6, and thus are detachable. It is preferable for the cylindrical member 2 to be replaceable because formation of ice plugs causes plastic deformation thereof. The flexible hose 5 is detachable by the joint 6, and thus the flexible hose 5 can be reused.

The coolant supply device 7 stores the coolant medium, and pumps the coolant medium via the flexible hose 5 to the ice plug forming unit 10. The coolant recovery device 8 recovers the coolant medium having passed through the ice plug forming unit 10, via the flexible hose 5.

Next, a pipe diameter expansion method using the pipe diameter expansion apparatus 1 according to this embodiment will be described.

First, the ice plug forming unit 10 with the flexible hoses 5 being connected to the both ends thereof is placed in the pipe 20 whose diameter is to be expanded. At this time, the ice plug forming unit 10 is placed in a position where the pipe diameter is to be expanded, and secured so as not to be displaced in a following process. The two flexible hoses 5 are connected to the coolant supply device 7 and the coolant recovery device 8, respectively.

Then, a space between the inner wall of the pipe 20 and the outer wall of the ice plug forming unit 10 is filled with water. Then, the coolant medium is supplied via the flexible hose 5 to the cylindrical member 2 of the ice plug forming unit 10. The coolant medium flows in one direction from the coolant supply device 7 to the coolant recovery device 8.

Figure 3:
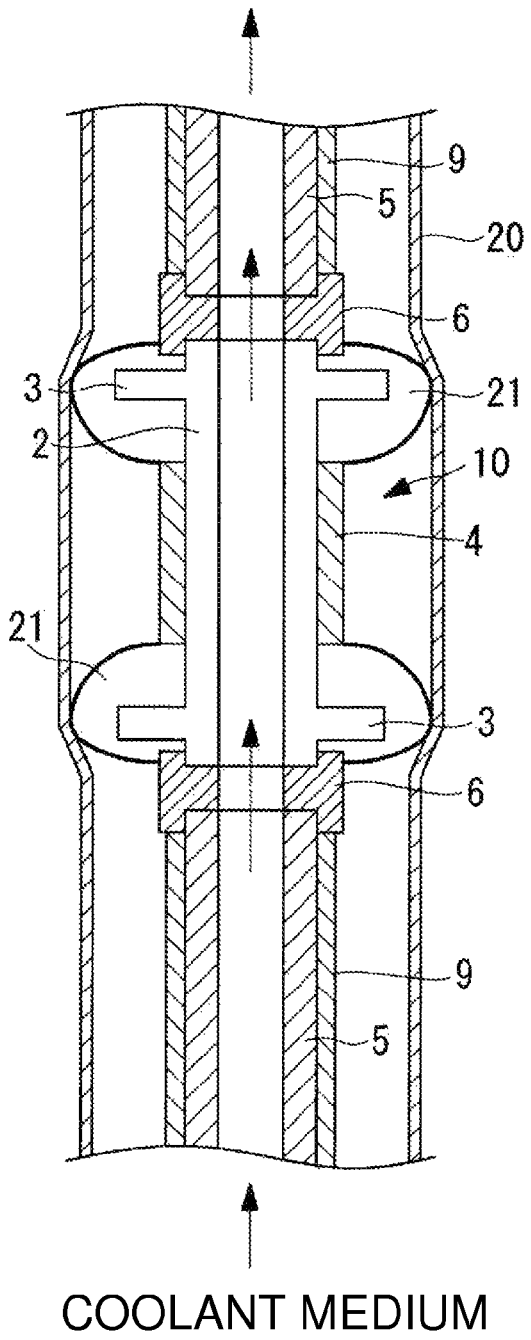
FIG. 3 is a partially enlarged vertical sectional view of the pipe diameter expansion apparatus according to the embodiment of the present invention, with a pipe starting to expand.

Thus, the outer surface of the cylindrical member 2 and the outer surface of the fin 3 that are not covered with the cold-heat insulator 4 are cooled, and the water in the pipe 20 starts to freeze. Since the fin 3 is formed to protrude outward from the cylindrical member 2, ice plugs that block the gap between the ice plug forming unit 10 and the inner wall of the pipe 20 are first formed at two spots corresponding to the fins 3. At this time, as shown in FIG. 3, expansion of the pipe diameter may be started depending on conditions. Reference numeral 21 in FIG. 3 denotes the ice plug.

Solidification of water in the pipe 20 proceeds toward the area between the two fins 3. As a result, the water remaining between the two fins 3 is trapped. Since phase transformation from water to ice involves volume expansion, pressure of the remaining water gradually increases. Thus, the water pressure and the volume expansion when water turns into ice cause the pipe 20 to yield and plastically deform, thus expanding the pipe diameter between the two fins 3.

Then, the supply of the coolant medium is stopped, the ice is melted, water is discharged from the inside the pipe 20, and the ice plug forming unit 10 together with the flexible hose 5 is taken out from the pipe 20. The pipe 20 yields and plastically deforms, thereby maintaining the expanded pipe diameter.

According to this embodiment, the pipe diameter expansion apparatus 1 provided in the pipe 20 forms the ice plugs at two spots corresponding to the two fins 3, and the pipe diameter can be expanded by volume expansion and an increase in internal pressure when the water trapped between the two ice plugs turns into ice as the ice plugs grow.

When the ice plug is formed, the inside of the pipe 20 can be cooled by the pipe diameter expansion apparatus 1 provided only in the pipe 20 rather than cooled from outside the pipe 20. Thus, even in a case where there is not much space because a plurality of pipes 20 are densely placed or other devices are placed around the pipe 20, and a cooling unit or a coolant medium pipe cannot be placed outside the pipe 20 or an operator cannot come close to the pipe 20, an ice plug can be formed to expand the pipe diameter.

In the above described embodiment, the case where the fins 3 are provided at two spots, which are both ends of the cylindrical member 2, has been described, but the present invention is not limited to this example. Fins 3 may be provided at three or more spots in appropriate positions of the cylindrical member 2, and cold-heat insulators 4 may be placed between the fins 3. This allows an ice plug to be formed in a short time even if a longitudinal range which is to be radially expanded is long.

Figure 4:
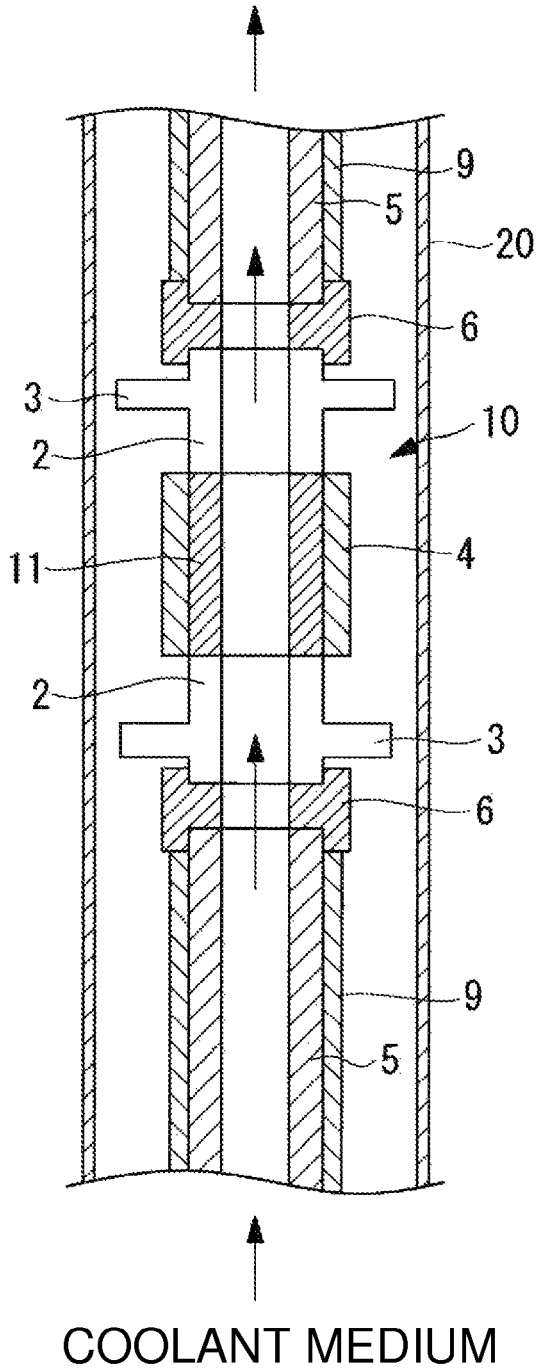
FIG. 4 is a partially enlarged vertical sectional view of a modified embodiment of the pipe diameter expansion apparatus of the embodiment of the present invention.

Also, as shown in FIG. 4, one fin 3 may be provided in one cylindrical member 2, and two cylindrical members 2 and another cylindrical member 11 including a cold-heat transmission reduction unit such as a cold-heat insulator 4 placed between the cylindrical members 2 may be combined. Also in this case, ice plugs are first formed at two spots corresponding to the two fins 3.

In the above described embodiment, the case where the one ice plug forming unit 10 is placed between the coolant supply device 7 and the coolant recovery device 8 to cool the inside of the pipe 20 has been described, but the present invention is not limited to this example. For example, two or more ice plug forming units 10 may be placed via the flexible hoses 5 and between the coolant supply device 7 and the coolant recovery device 8. This allows different ice plugs to be formed in separate positions, and allows the pipe diameter to be expanded at a plurality of spots substantially at the same time. This can reduce an operation time when the pipe 20 is long and needs to be expanded at a plurality of spots.

In the above described embodiment, the case where the cold-heat insulator 4 is used as an example of the cold-heat transmission reduction unit has been described, but the present invention is not limited to this example. The cold-heat transmission reduction unit may be, for example, a heater for adjusting temperature. This can adjust a solidification speed or a solidification direction of water in the pipe 20.

REFERENCE SIGNS LIST

1 pipe diameter expansion apparatus
2, 11 cylindrical member
3 fin
4, 9 cold-heat insulator
5 flexible hose
6 joint
7 coolant supply device
8 coolant recovery device

10 ice plug forming unit
20 pipe

The invention claimed is:

1. A pipe diameter expansion apparatus comprising:

a hollow cylindrical member which can be placed in a pipe filled with water, and through which a coolant medium having a lower solidification point than a freezing point of the water flows from one end to the other end thereof;

two or more plate-like fins provided to protrude outward from the cylindrical member; and a cold-heat transmission reduction unit that is provided between the fins, and reduces cold-heat transmission between an inside and an outside of the cylindrical member.

2. The pipe diameter expansion apparatus according to claim 1, further comprising two hoses more elastic than the cylindrical member and connected to ends of the cylindrical member, respectively, wherein the coolant medium flows through the hoses.

3. A pipe diameter expansion method using a pipe diameter expansion apparatus according to claim 1, comprising the steps of:

filling a pipe with water;

placing the pipe diameter expansion apparatus in the pipe; and supplying the coolant medium into the cylindrical member of the pipe diameter expansion apparatus.

4. A pipe diameter expansion method using a pipe diameter expansion apparatus according to claim 2, comprising the steps of:

filling a pipe with water;

placing the pipe diameter expansion apparatus in the pipe; and supplying the coolant medium into the cylindrical member of the pipe diameter expansion apparatus.

* * * * *